US012630263B2

(12) United States Patent
Wilson et al.

(10) Patent No.: US 12,630,263 B2
(45) Date of Patent: May 19, 2026

(54) DUAL FOLD TOWER

(71) Applicant: ROSWELL CANADA INC., Acheson (CA)

(72) Inventors: Darrick J. Wilson, Edmonton (CA); Matt Lane, Edmonton (CA)

(73) Assignee: ROSWELL CANADA INC., Acheson (CA)

( * ) Notice: Subject to any disclaimer, the term of this patent is extended or adjusted under 35 U.S.C. 154(b) by 580 days.

(21) Appl. No.: 18/126,554

(22) Filed: Mar. 27, 2023

(65) Prior Publication Data

US 2023/0303217 A1 Sep. 28, 2023

Related U.S. Application Data

(60) Provisional application No. 63/323,563, filed on Mar. 25, 2022.

(51) Int. Cl.
*B63B 17/02* (2006.01)
*B63B 17/00* (2006.01)

(52) U.S. Cl.
CPC ..... *B63B 17/02* (2013.01); *B63B 2017/0054* (2013.01); *B63B 2017/026* (2013.01)

(58) Field of Classification Search
CPC . B63B 17/00; B63B 17/02; B63B 2017/0054; B63B 2017/026
USPC ..... 114/361
See application file for complete search history.

(56) References Cited

U.S. PATENT DOCUMENTS 11,345,444 B2 5/2022 Mills et al.

OTHER PUBLICATIONS

HMG (Hi-Tide Manufacturing) Launch GT Synchronous Motion Folding Arch and Hard Top; Sep. 28-30, 2021, 1 page.

*Primary Examiner* — Lars A Olson
(74) *Attorney, Agent, or Firm* — Timothy H. Van Dyke; Wolter Van Dyke Davis, PLLC

(57) ABSTRACT

An apparatus (100), including: a support assembly (200), the support assembly including: a lower endcap (240), an upper endcap (252), a strut (242), a lower pivot joint (244) between the lower endcap and a lower end (248) of the strut, and an upper pivot joint (254) between the upper endcap and an upper end of the strut (246). The support assembly is configured to selectively move an upper structure (400) relative to a motor vehicle (500) between an upper position via rotation at each pivot joint which increases a distance (270) between respective endcap centroids (272, 274), and a lower position via rotation in an opposite direction at each pivot joint which decreases the distance (276) between the respective endcap centroids.

15 Claims, 15 Drawing Sheets

DUAL FOLD TOWER

FIELD OF THE INVENTION

The invention relates to a support with pivoting elements that raise and lower an upper structure.

BACKGROUND OF THE INVENTION

Recreational vehicles such as marine vessels and all-terrain vehicles often have an upper structure including a top cover intended to provide protection from the elements. Under certain circumstances, such as a boat approaching a low clearance, it is necessary to be able to lower the top cover. In response, the industry has provided various configurations of selectively adjustable supports that allow for raising and lower the top covers. However, there remains room in the art for improvement.

BRIEF DESCRIPTION OF THE DRAWINGS

The invention is explained in the following description in view of the drawings that show.

DETAILED DESCRIPTION OF THE INVENTION

The present inventors have created a unique and innovative support structure and upper structure that can be used with a variety of motor vehicles, including marine vessels such as pleasure boats and the like. The support structure and upper structure overcome difficulties associated with the prior art by making it easier to raise and lower, by designing it to be stronger in both the raised and lower positions, by configuring it to be usable as a weather enclosure during inclement weather, and by increasing safety by minimizing safety hazards such as pinch points associated with prior art designs and providing improved vehicle operation in inclement weather.

Figure 1:
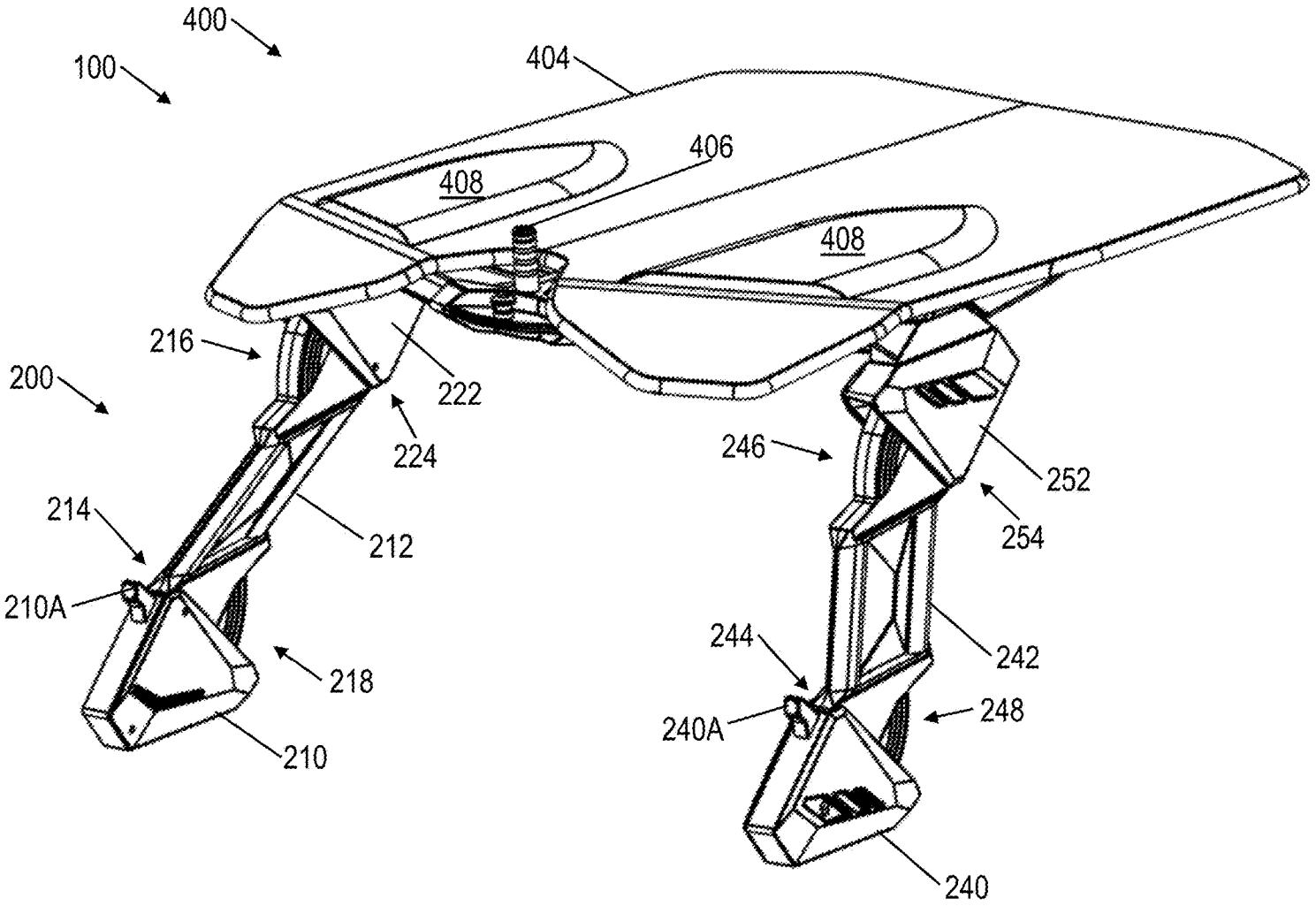
FIG. 1 is a perspective view of an example embodiment of a support assembly in an upper position and an example embodiment of an upper structure with an example embodiment of a top cover in a forward position.

FIG. 1 is a perspective view of an example embodiment of an apparatus 100 that includes a support assembly 200 in an upper position and an example embodiment of an upper structure 400 in a forward position. The apparatus 100 is disclosed herein using terms associated with being installed in a particular orientation on a marine vessel for sake of clarity and simplicity. However, the apparatus 100 is not limited to any particular orientation or any particular vessel. The apparatus 100 can be installed in any orientation on any suitable motor vehicle.

The support assembly 200 includes a port lower endcap 210 configured to be rigidly secured to a motor vehicle (e.g., a recreational boat) and optionally including a port storage rack mount 210A, and a port strut 212. A port lower pivot joint 214 is disposed therebetween and configured to selectively raise and lower an upper end 216 of the port strut 212 when a lower end 218 the port strut 212 is rotated relative to the port lower endcap 210 about a port lower pivot axis 220 (see FIG. 6) of the port lower pivot joint 214. A port upper endcap 222 is secured to the upper end 216 of the port strut 212 via a port upper pivot joint 224 and is configured to be secured to an upper structure 400. The port upper pivot joint 224 is configured to selectively adjust an orientation of the upper structure 400 by rotating the upper end 216 of the port strut 212 relative to the port upper endcap 222 about a port upper pivot axis 226 of the port upper pivot joint 224.

The support assembly 200 further includes a starboard lower endcap 240 configured to be secured to the motor vehicle and optionally including a starboard storage rack mount 240A, and a starboard strut 242. A starboard lower pivot joint 244 is disposed therebetween and is configured to selectively raise and lower an upper end 246 of the starboard strut 242 when a lower end 248 of the starboard strut 242 is rotated relative to the starboard lower endcap 240 about a starboard lower pivot axis 250 of the starboard lower pivot joint 244. A starboard upper endcap 252 is secured to the upper end 246 of the starboard strut 242 via a starboard upper pivot joint 254 and is configured to be secured to the upper structure 400. The starboard upper pivot joint 254 is also configured to selectively adjust an orientation of the upper structure 400 by rotating the upper end 246 of the starboard strut 242 relative to the starboard upper endcap 252 about a starboard upper pivot axis 264 of the starboard upper pivot joint 254.

The upper structure 400 may include any of a crossbar 402, a top cover 404, a tow head 406, and/or storage elements 408 (e.g., storage racks, compartments, and/or watersports board pockets). The ability to selectively adjust the orientation of the upper structure 400 obviates any need to remove the top cover 404 when moving the support assembly 200 from the upper position and also the need to separately store the top cover 404.

In this example embodiment, the port lower pivot axis 220, the port upper pivot axis 226, the starboard lower pivot axis 250, and the starboard upper pivot axis 256 are all parallel to each other. In this example embodiment, the port lower pivot axis 220 and the starboard lower pivot axis 250 are the same/common, and the port upper pivot axis 226 and the starboard upper pivot axis 256 are the same/common.

Any of the components discussed may be composed of plastic, aluminum, steel, and/or stainless steel.

Figure 2:
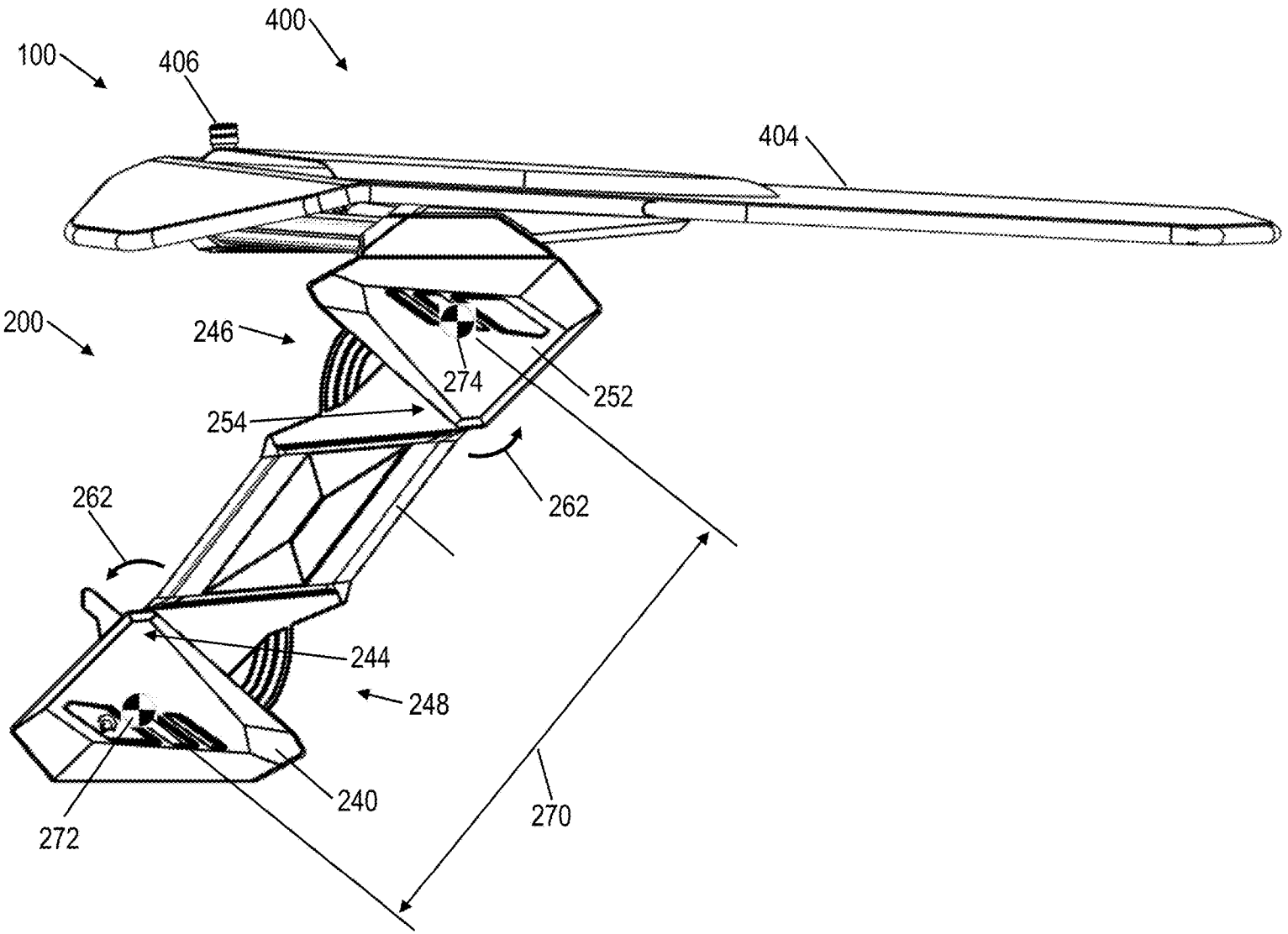
FIG. 2 is a side view the support assembly of FIG. 1 in the upper position and the top cover of FIG. 1 in the forward position.
Figure 3:
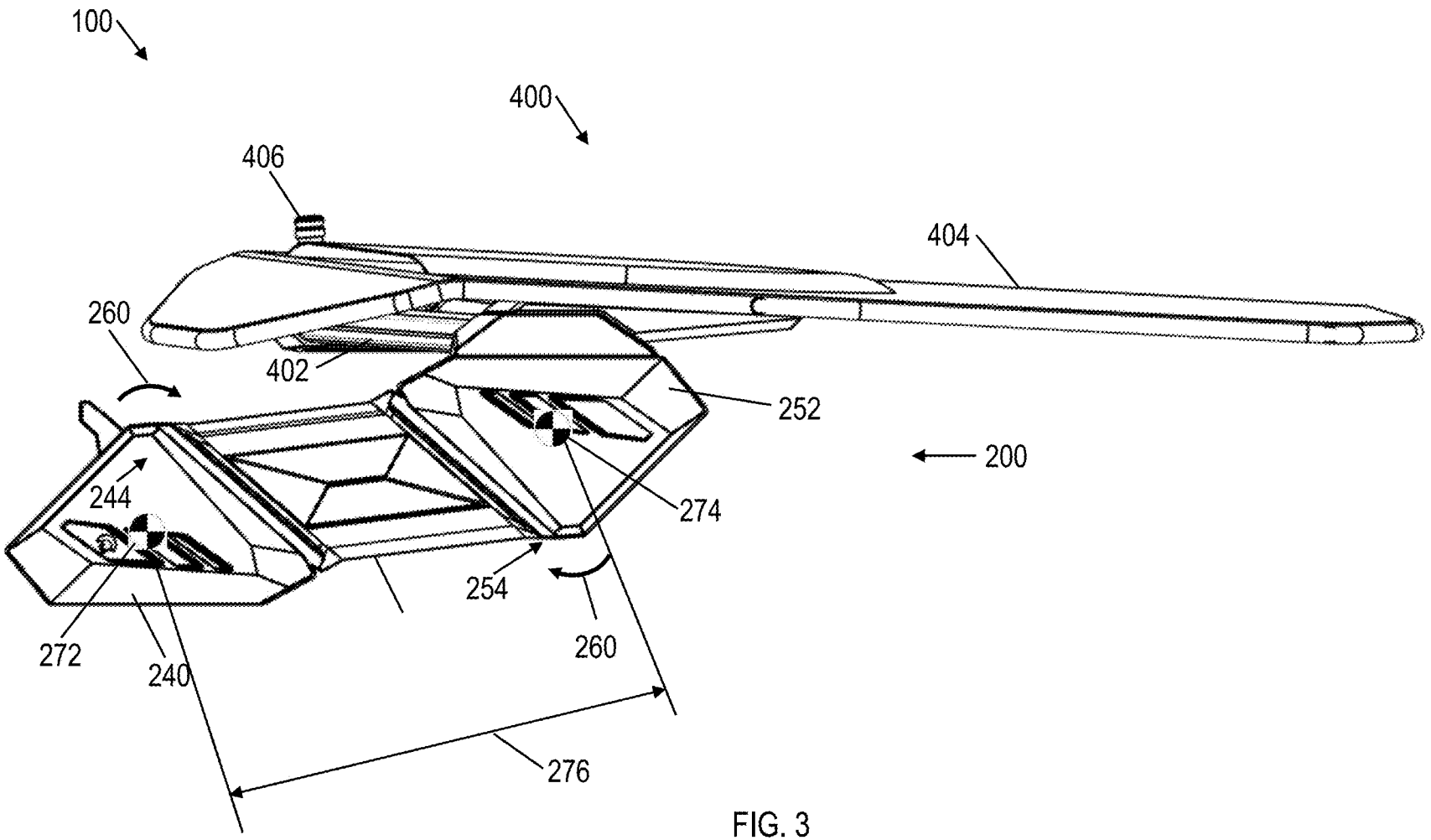
FIG. 3 is a side view of the support assembly of FIG. 1 in a lower position and the top cover of FIG. 1 in the forward position.

As is best seen between FIG. 2 and FIG. 3, the support assembly 200 and the upper structure 400 are raised and lowered by rotation of the struts relative to the respective lower endcap about the respective lower pivot axis. While the operation described below focuses on the starboard components of the support assembly 200, the principles of operation apply to the port components as well.

To lower the support assembly 200 from the upper position of FIG. 2 to the lower position of FIG. 3, the lower end 248 of the starboard strut 242 is rotated in a first direction 260 (clockwise in FIG. 3) relative to the starboard lower endcap 240 about the starboard lower pivot axis 250 of the starboard lower pivot joint 244. An orientation of the upper structure 400 can be adjusted independently, and this independent adjustment can occur whether or not the lower end 248 of the starboard strut 242 is rotated about the starboard lower pivot axis 250. To maintain the orientation of the upper structure 400 as the support assembly 200 is lowered, the upper end 246 of the starboard strut 242 is also rotated in the first direction 260 (clockwise in FIG. 3) relative to the starboard upper endcap 252 about the starboard upper pivot axis 256 of the starboard upper pivot joint 254. Consequently, to move from the upper position shown in FIG. 2 to the lower position shown in FIG. 3, the starboard strut 242 is rotated relative to the respective endcaps in the same first direction 260.

To raise the support assembly 200 and upper structure 400, the lower end 248 of the starboard strut 242 is rotated in a second direction 262 (counterclockwise in FIG. 2) relative to the starboard lower endcap 240 that is opposite the first direction 260 about the starboard lower pivot axis 250 of the starboard lower pivot joint 244. To maintain the orientation of the upper structure 400 as the support assembly 200 is raised, the upper end 246 of the starboard strut 242 is also rotated in the second direction 262 (counterclockwise in FIG. 2) relative to the starboard upper endcap 252 about the starboard upper pivot axis 256 of the starboard upper pivot joint 254. Consequently, to move from the lower position shown in FIG. 3 to the upper position shown in FIG. 2, the starboard strut 242 is rotated relative to the respective endcap in the same second direction 262, which is opposite the first direction 260.

In the upper position, an upper position distance 270 between a starboard lower endcap centroid 272 and a starboard upper endcap centroid 274 is greater than a lower position distance 276 between the starboard lower endcap centroid 272 and a starboard upper endcap centroid 274. This is due to a folding action associated with the rotation of the lower end 248 of the starboard strut 242 about the starboard lower pivot joint 244 and the rotation of the upper end 246 of the starboard strut 242 about the starboard upper pivot joint 254. Consequently, the support assembly 200 compacts when going from the upper position to the lower position and decompacts when going from the lower position to the upper position. Reducing the distance between the centroids reduces moment arms/leverage arms associated with the upper structure 400 which, in turn, creates a stiffer/stronger apparatus 100. Having a relatively strong compacted apparatus 100 allows the apparatus 100 to be used for all the same activities when compacted as when decompacted.

Figure 4:
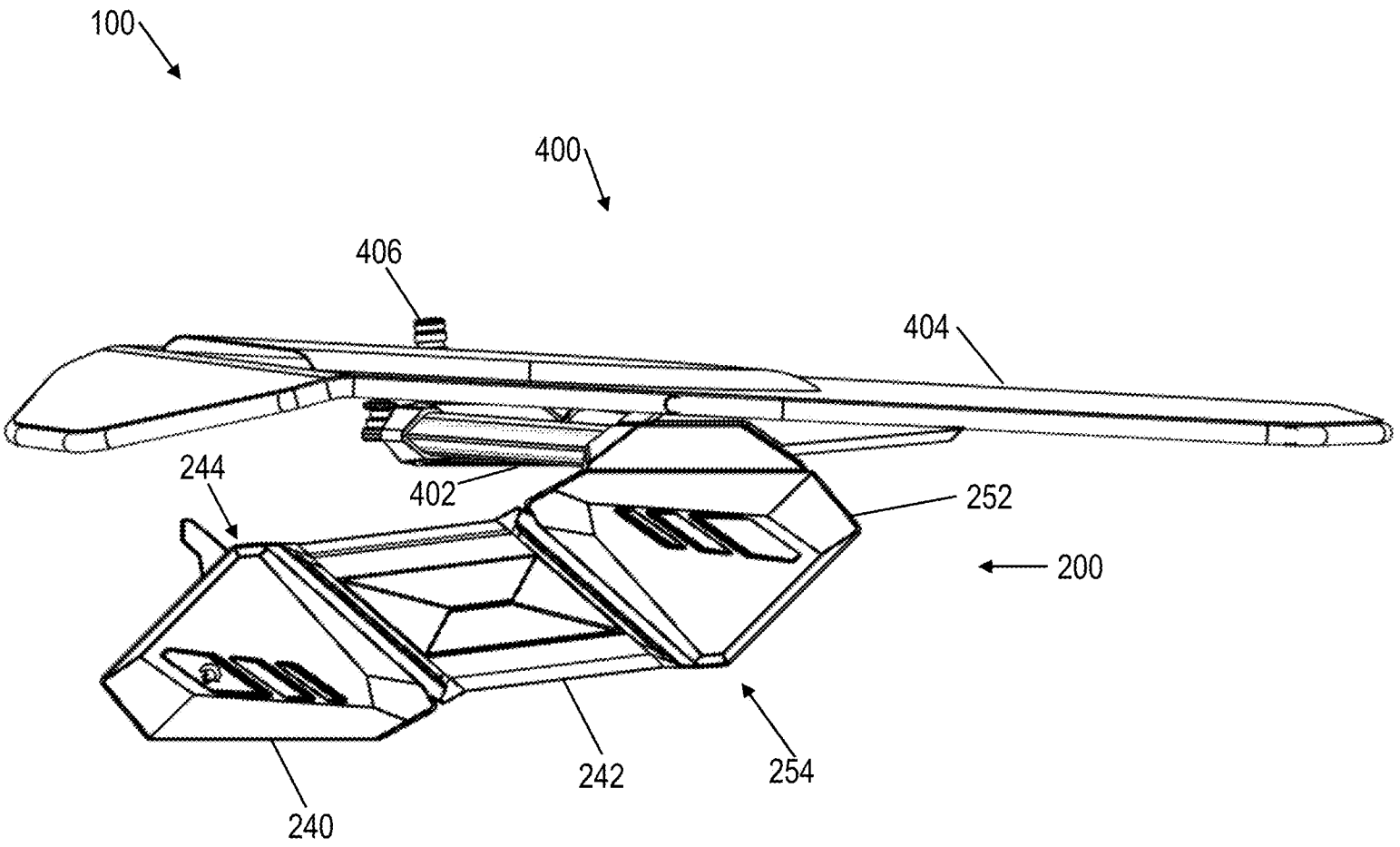
FIG. 4 is a side view of the support assembly of FIG. 1 in the lower position and the top cover of FIG. 1 in an aft position.
Figure 5:
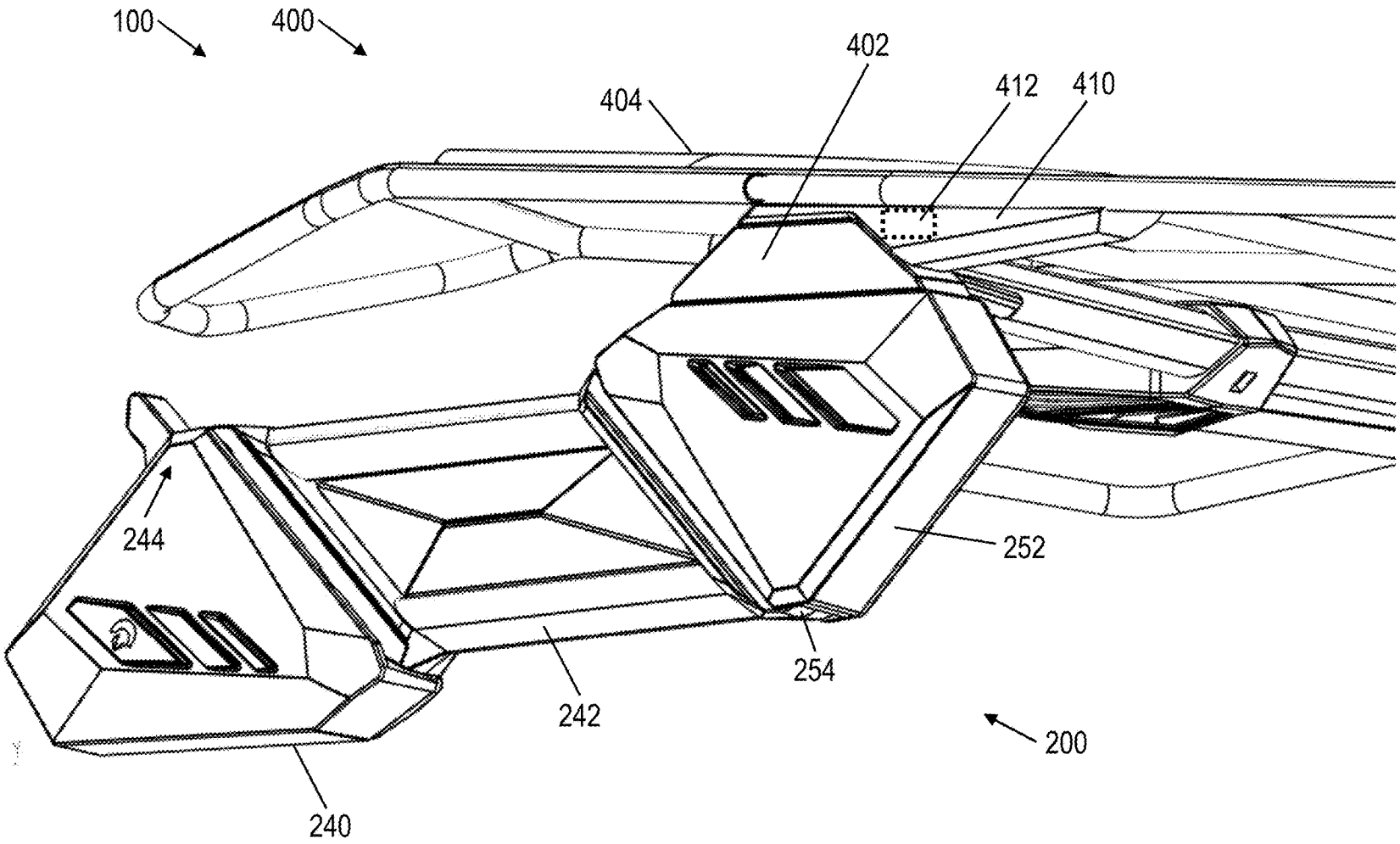
FIG. 5 is a perspective view of the support assembly of FIG. 1 in the lower position and the top cover of FIG. 1 in the aft position.

As can be seen between FIG. 3 to FIG. 5, the top cover 404 is selectively adjustable between a forward position as shown in FIG. 3, and an aft position as shown in FIG. 4 and FIG. 5. In an example embodiment, the top cover 404 is secured to the crossbar 402 via at least one top cover bracket 410 and is moved between the forward and aft positions via an actuator 412 associated with the top cover bracket 410. In alternate example embodiments, there may be one or more actuators 412 and the actuators may be positioned anywhere suitable to enable the top cover 404 to move between the forward and aft positions. The top cover 404 in this example embodiment is independently adjustable between the forward and aft positions and any position in between. Consequently, the top cover 404 can be moved between the forward and aft positions when the support assembly 200 is in the upper position, the lower position, or anywhere in between. When the support assembly is in the lower position, the ability to independently adjust the orientation of the top cover 404 as well as the ability to independently adjust the top cover 404 between the forward and aft positions allows the operator to tailor the position the top cover 404 as desired. For example, the top cover 404 can be positioned to align with a windshield to provide rain cover during inclement conditions while enabling the operator the visibility necessary to continue to operate the boat, which increases occupant comfort and safety.

Figure 6:
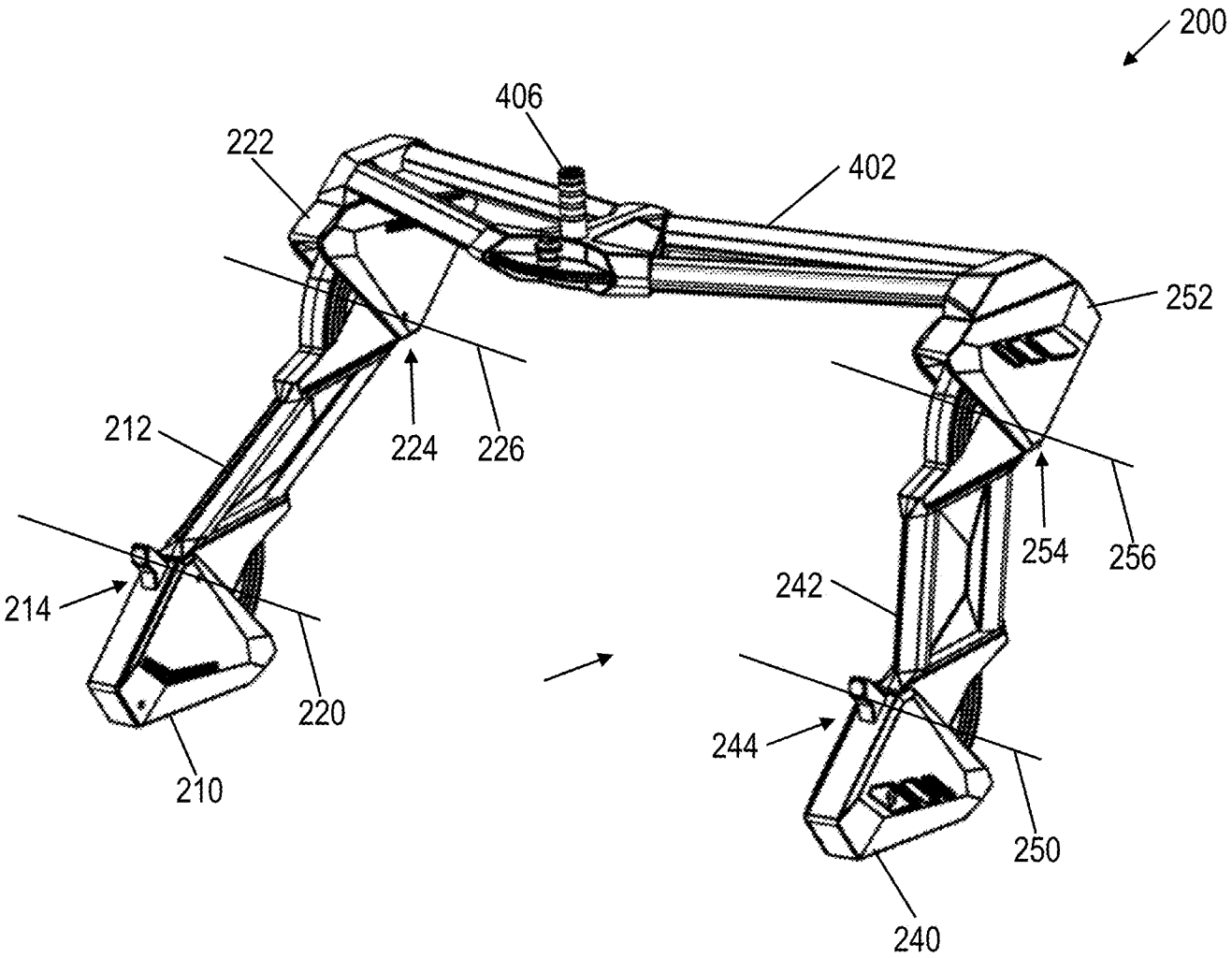
FIG. 6 shows the support assembly of FIG. 1 in the upper position with the top cover removed.
Figure 7:
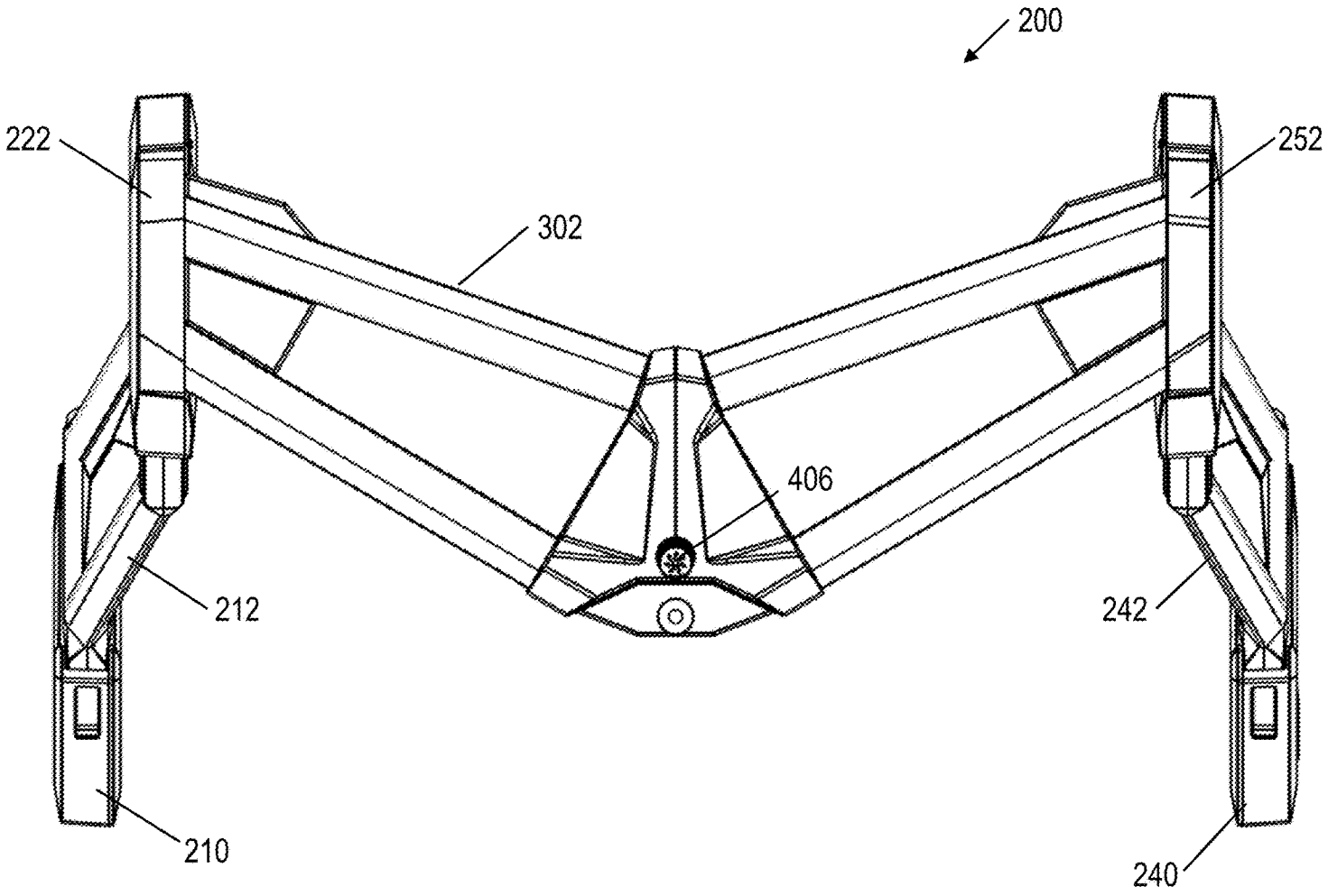
FIG. 7 is a top view of the support assembly of FIG. 6.
Figure 8:
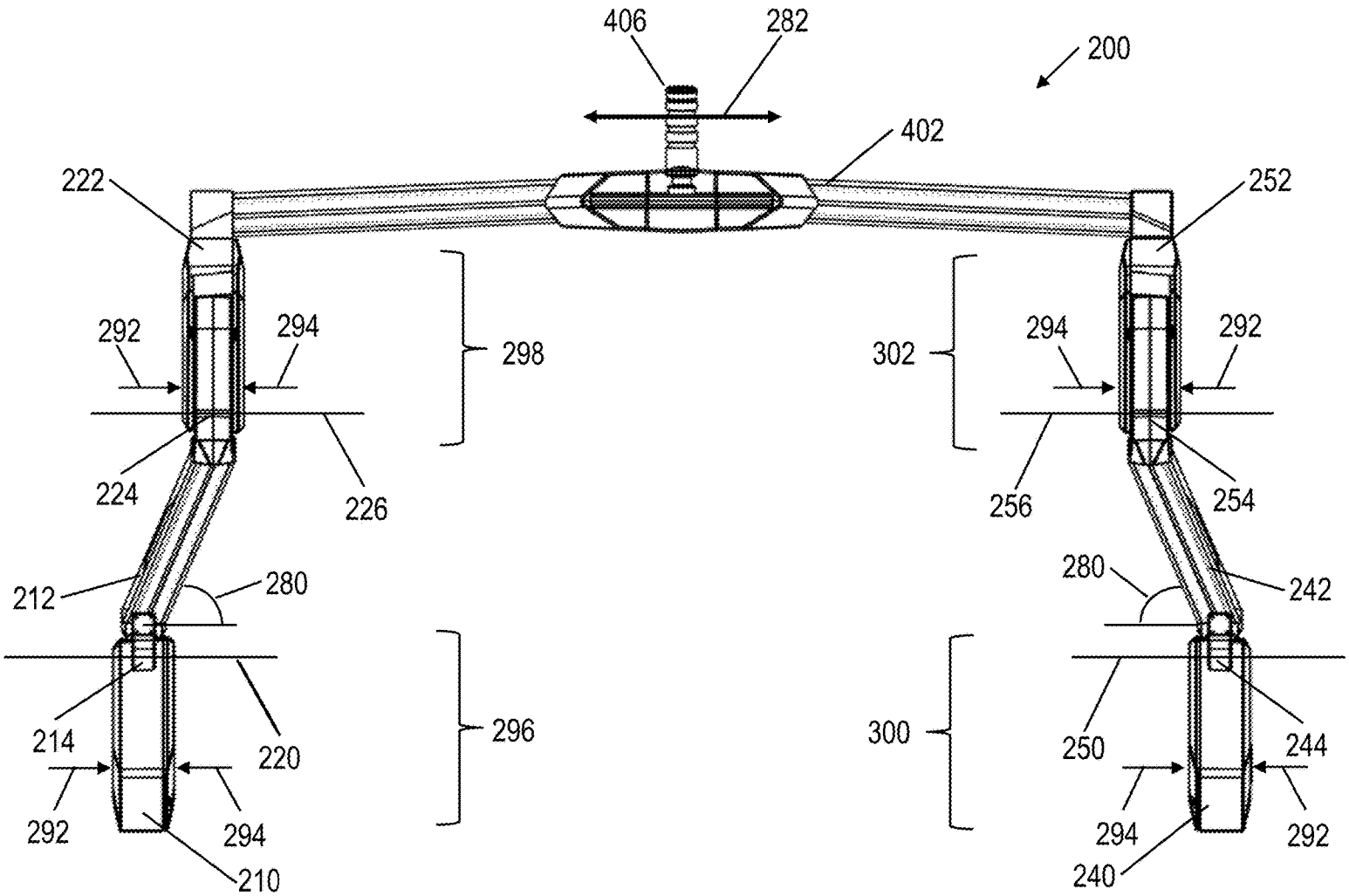
FIG. 8 is a rear view of the support assembly of FIG. 6.

FIG. 6 to FIG. 8 are various views of the support assembly 200 with the top cover 404 removed. As can best be seen in FIG. 8, both the port strut 212 and the starboard strut 242 are canted inward toward each other at a cant angle 280. The cooperating cants of the port strut 212 and the starboard strut 242 help the support assembly 200 resist lateral forces 282 by converting what would otherwise be pure bending moments on the port strut 212 and the starboard strut 242 into forces directed at least partly along a longitudinal extent of each strut. This lateral stiffness can be beneficial when the motor vehicle is rolling from side to side and the inertia of the top cover 404 imparts lateral forces 282 to the support assembly 200. This lateral stiffness can also be beneficial when a load being towed, such as a wakeboarder, is not directly behind the boat and thereby applies the lateral forces 282.

In addition to the canted struts, the support assembly is made stronger by one or more discrete guide arrangements 290 (See FIG. 12) associated with one or more of the pivot joints. The guide arrangements 290 provide a second point of contact for a pivot joint that is discrete from the pivot joint. This helps maintain the proper alignment between the endcap and strut associated with the pivot joint.

In the example embodiment shown, each guide arrangement 290 provides both a laterally outward point of contact 292 and a laterally inward point of contact 294. The port lower pivot joint 214, the laterally outward point of contact 292, and the laterally inward point of contact 294 reinforce and thereby stiffen a port lower section 296 of the support assembly 200 in a way that resists lateral forces 282. Similarly, the port upper pivot joint 224 the laterally outward point of contact 292, and the laterally inward point of contact 294 reinforce and thereby stiffen a port upper section 298 in a way that resists lateral forces 282. A starboard lower section 300 and a starboard upper section 302 are likewise reinforced and thereby stiffened. Having reinforced and stiffened lower sections 296, 300, reinforced and stiffened upper sections 298, 302, and cooperatively canted struts 212, 242 results in a support assembly 200 that is uniquely strong, rigid, and able to resist the lateral forces 282.

While each pivot joint in this example embodiment is provided with both a laterally outward point of contact 292 and a laterally inward point of contact 294, both are not necessary to reinforce the support assembly 200 against lateral forces 282. In an alternate example embodiment, each of the lower sections 296, 300 is provided with only a laterally outward point of contact 292. In such an example embodiment, the port lower section 296 would be reinforced against left lateral forces (as seen in FIG. 8), whereas the starboard lower section 300 would be reinforced against right lateral forces (as seen in FIG. 8). Together, these lower sections 296, 300 would reinforce and stiffen the support assembly 200 against both left and right lateral forces 282.

Alternately, each of the lower sections 296, 300 may be provided with only a laterally inward point of contact 294. In such an example embodiment, the port lower section 296 would be reinforced against right lateral forces (as seen in FIG. 8), whereas the starboard lower section 300 would be reinforced against left lateral forces (as seen in FIG. 8). Here again, together these lower sections 296, 300 would reinforce and stiffen the support assembly 200 against both left and right lateral forces 282. The same principles can be applied to the upper sections 298, 302. In addition, any combination of pivot joints and lateral points of contact can be used to resist the lateral forces 282 as desired.

Figure 9:
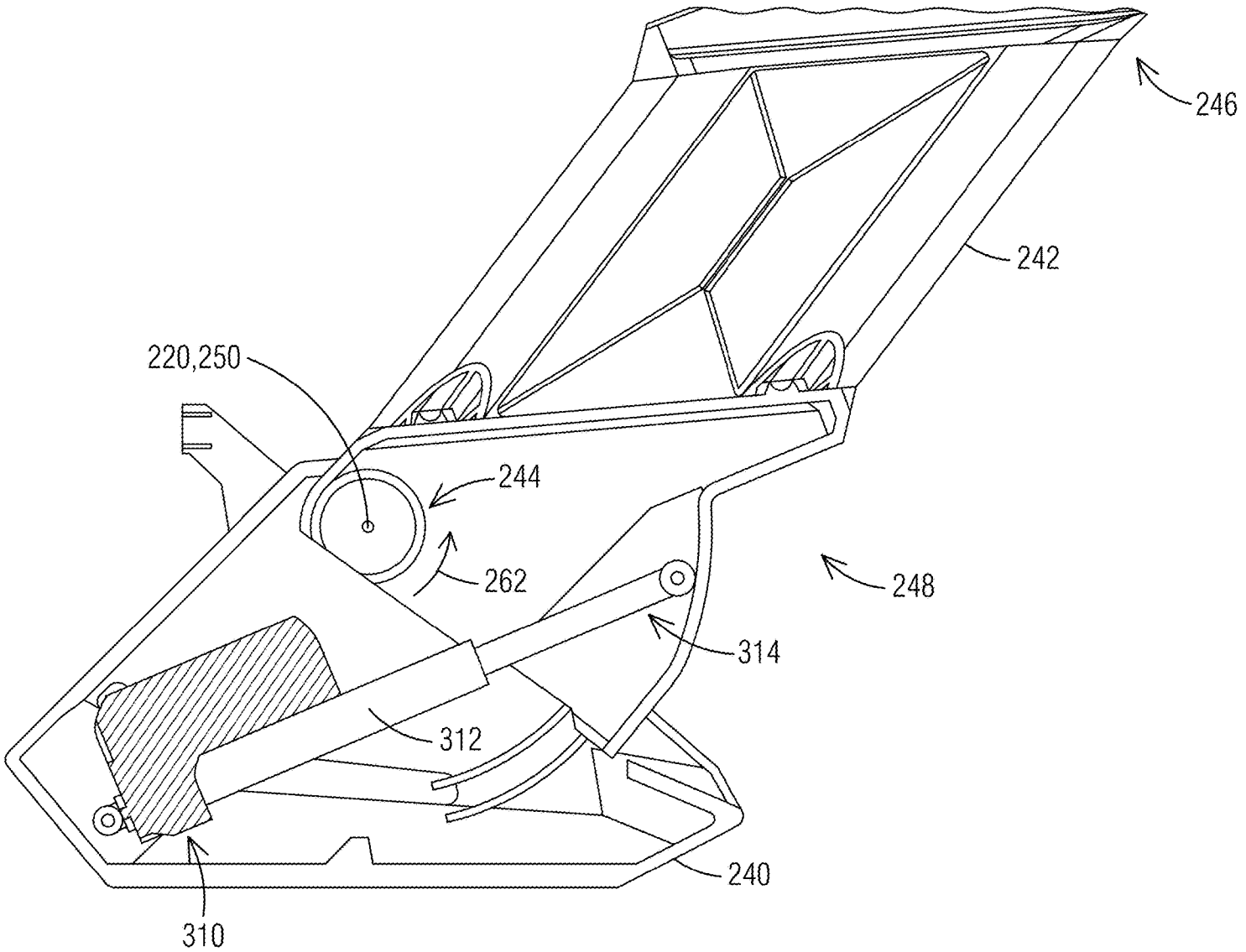
FIG. 9 is a sectional view showing an example embodiment of an actuator of the support assembly of FIG. 1 when the support assembly is in the upper position.
Figure 10:
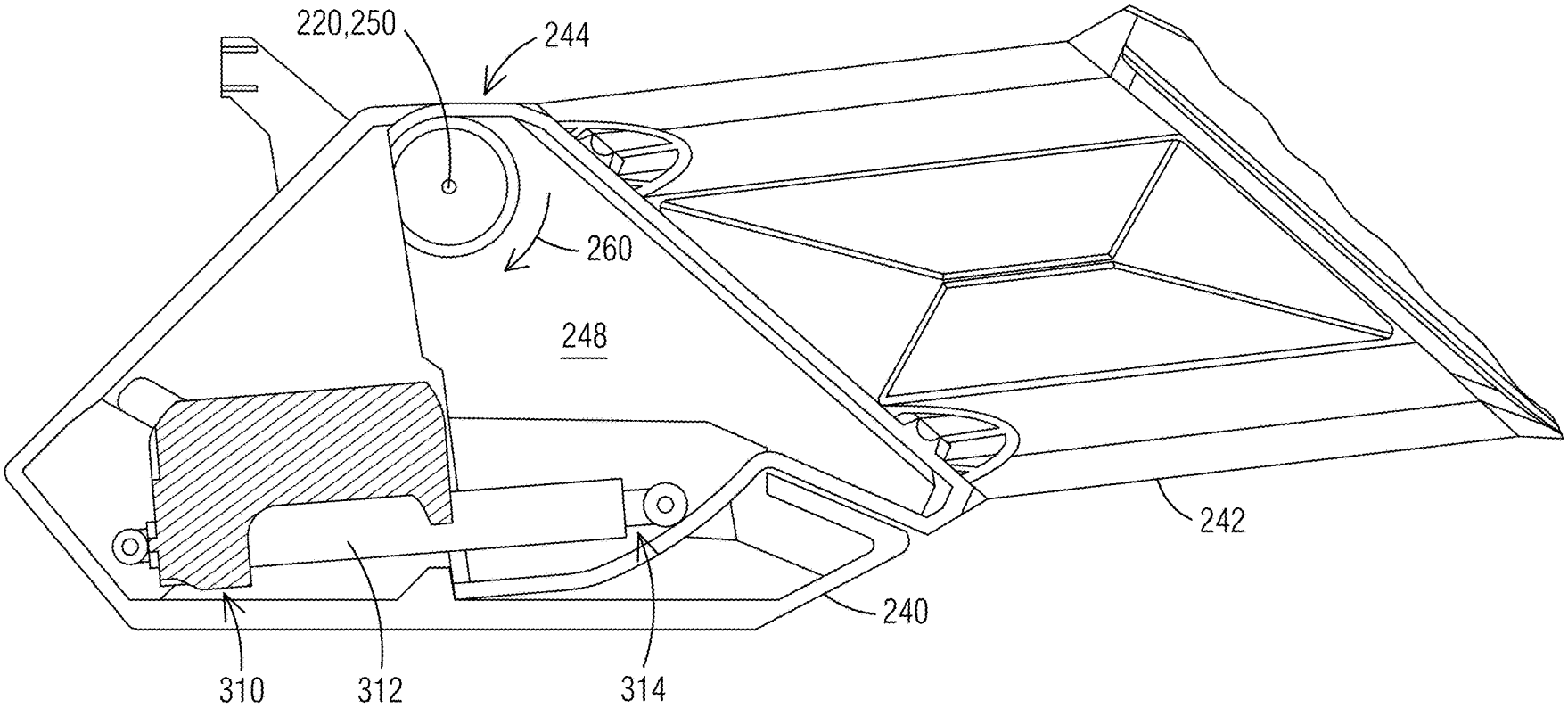
FIG. 10 is a sectional view of the actuator of the support assembly of FIG. 1 when the support assembly is in the lower position.

As can best be seen in FIG. 9 and FIG. 10, a first end 310 of a lower actuator 312 (e.g., a screw actuator, an electric actuator, a hydraulic actuator, a pneumatic actuator etc.) is secured relative to the starboard lower endcap 240. A second end 314 of the lower actuator 312 is secured to the lower end 248 of the starboard strut 242. In this example embodiment, extending the lower actuator 312 pivots the lower end 248 of the starboard strut 242 about the starboard lower pivot joint 244 in the second direction 262 to raise the upper end 246 of the starboard strut 242 as seen in FIG. 9. Conversely, retracting the lower actuator 312 pivots the lower end 248 of the starboard strut 242 about the starboard lower pivot joint 244 in the first direction 260 to lower the upper end 246 of the starboard strut 242 as seen in FIG. 10. Both of the lower endcaps and both of the upper endcaps have similar struts configured to operate in the same way. In an example embodiment, the lower endcaps, the lower actuators, and the lower end of the struts are interchangeable with each other and with the upper endcaps, the upper actuators, and the upper ends of the strut respectively.

Figure 11:
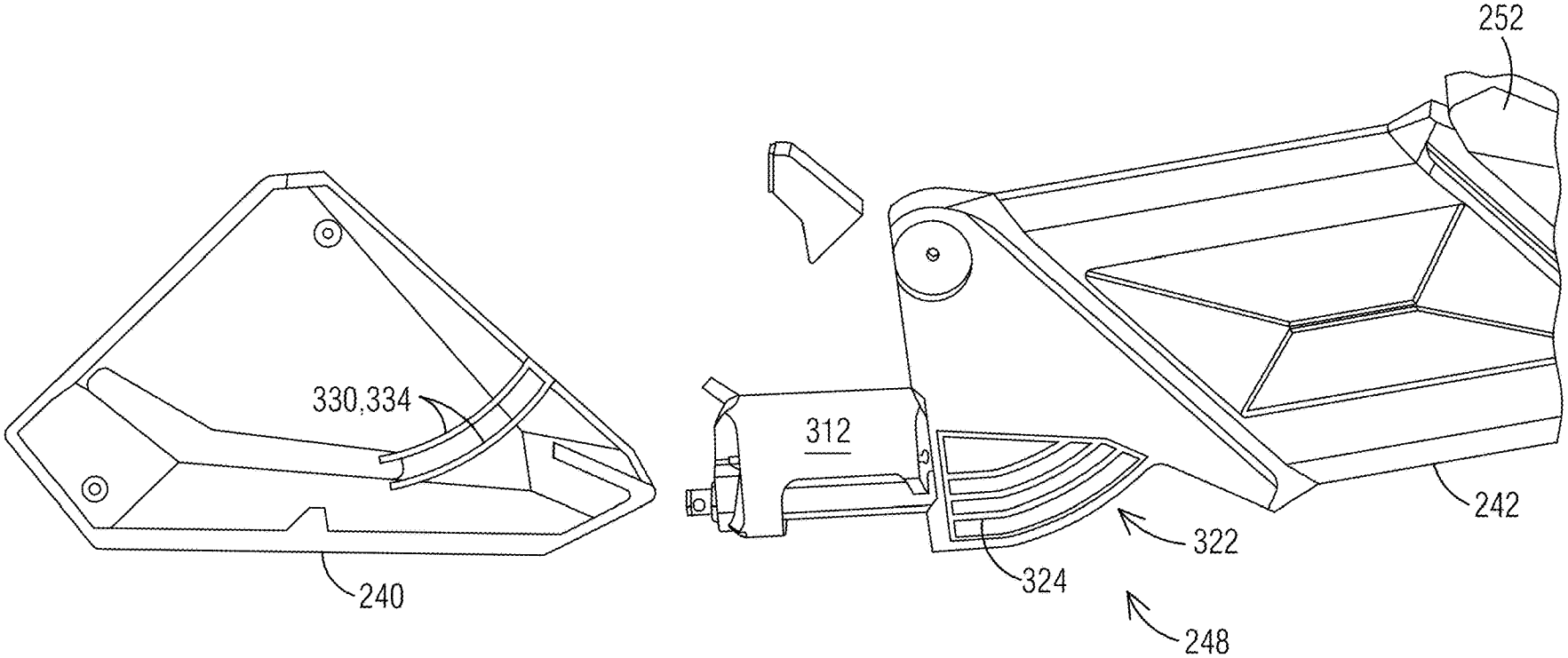
FIG. 11 is an exploded sectional view showing an example embedment of a guide arrangement the support assembly of FIG. 1 when the support assembly is in the lower position of FIG. 1.
Figure 12:
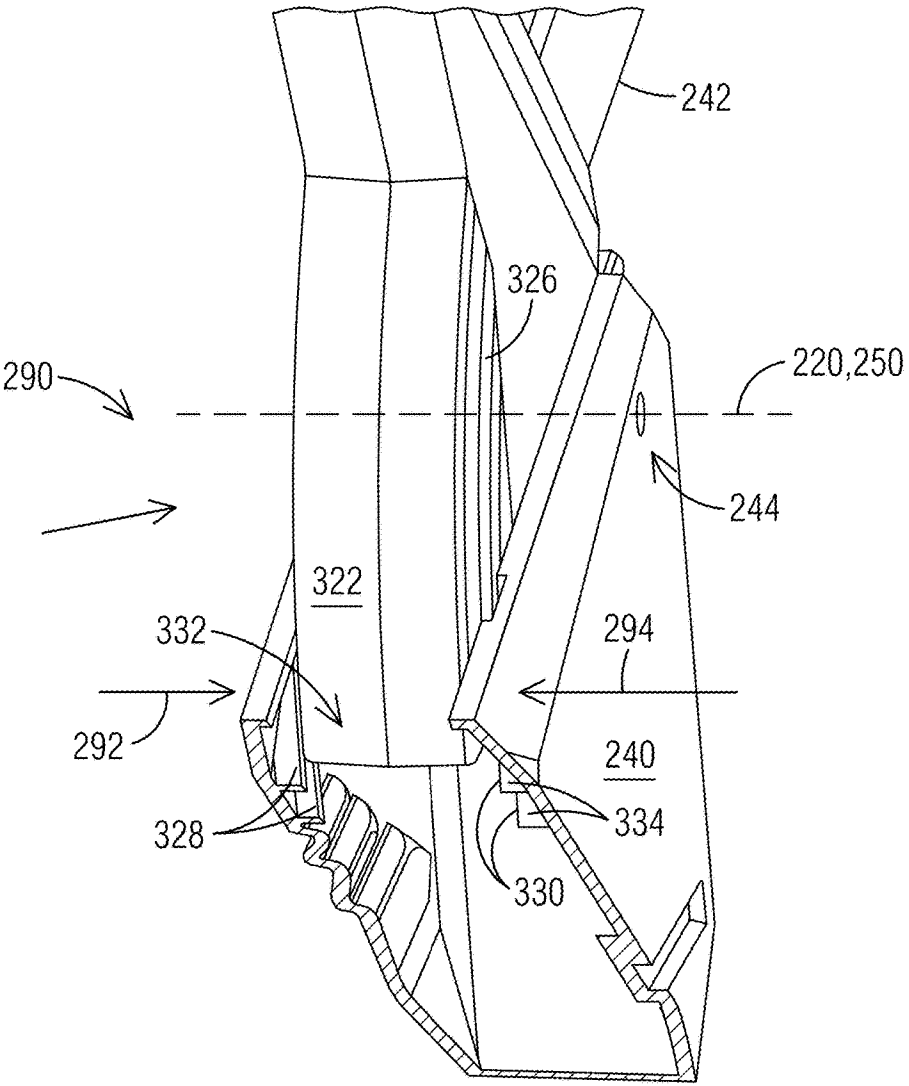
FIG. 12 is a sectional view of the guide arrangement the support assembly of FIG. 1 when the support assembly is in the upper position.

As can best be seen in FIG. 11 and FIG. 12, in this example embodiment the guide arrangement 290 includes a tongue 322 with tongue contact surfaces 324, 326 in sliding contact with groove contact surfaces 328, 330 of a groove 332. The sliding contact is disposed remote from the starboard lower pivot joint 244 (e.g., is not necessary to the existence of the pivot joint). The remote location aids in rotationally aligning the starboard lower endcap 240 with the starboard strut 242. Contact between the tongue contact surfaces 324 and the groove contact surfaces 328 creates the laterally outward point of contact 292. Contact between the tongue contact surfaces 326 and the groove contact surfaces 330 creates the laterally inward point of contact 294.

In this example embodiment, the sliding contact is maintained throughout an entire range of motion of between the lower position and the upper position, though this is not necessary. In an alternate example embodiment, contact may occur only after a threshold amount of lateral deflection. In this example embodiment, the tongue 322 has a somewhat arcuate shape that may be associated with the rotation about the starboard lower pivot joint 244. However, the arcuate shape is not necessary. The tongue contact surfaces 324, 326 and/or the groove contact surfaces 328, 330 may be part of a friction pad (e.g., a plastic friction pad). In this example embodiment, the groove contact surfaces 328 are disposed on raised, arcuate ridges 334 that may be associated with the rotation about the starboard lower pivot joint 244. However, the arcuate shape of the ridges 334 is not necessary.

In addition to providing lateral stability, the tongue and groove arrangement also increases safety by making it harder for a person to get pinched between the endcap and the strut.

Figure 13:
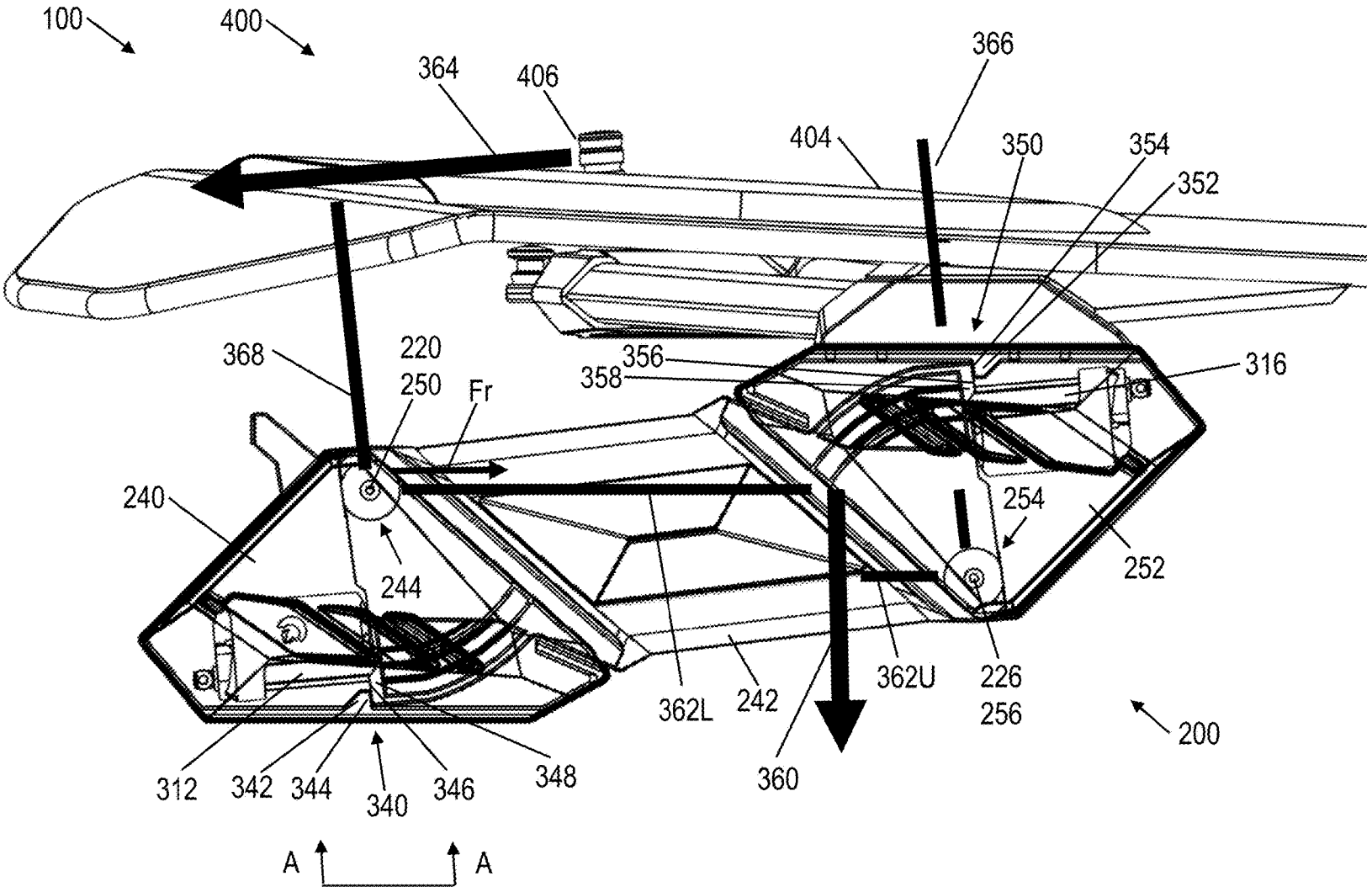
FIG. 13 is a side view of showing an example embodiment of positive stops of the support assembly of FIG. 1 when the support assembly is in the lower position.

FIG. 13 shows an example embodiment of positive stops of the support assembly 200 when the support assembly 200 is in the lower position. Shown are a starboard lower positive stop 340 and a starboard upper positive stop 350. There may likewise be a port lower stop and a port upper stop. In some example embodiments, there may be a positive stop associated with each endcap. In other example embodiments, there may be positive stops associated only with select endcaps. There may be any number of positive stops in the support assembly 200.

The starboard lower positive stop 340 includes a starboard lower positive stop first element 342 having a starboard lower positive stop first element contact surface 344 that abuts (e.g., mechanically seats with) a starboard lower positive stop second element contact surface 346 of a starboard lower positive stop second element 348 when the support assembly 200 is in the lower position. The starboard lower positive stop first element 342 shown is associated with the starboard lower endcap 240 and the starboard lower positive stop second element 348 is associated with the tongue 322 of the starboard strut 242.

The starboard upper positive stop 350 includes a starboard upper positive stop first element 352 having a starboard upper positive stop first element contact surface 354 that abuts (e.g., mechanically seats with) a starboard upper positive stop second element contact surface 356 of a starboard upper positive stop second element 358 when the support assembly 200 is in the lower position. The starboard upper positive stop first element 352 shown is associated with the starboard upper endcap 252 and the starboard upper positive stop second element 358 is associated with the respective tongue of the starboard strut 242. However, these associations are not necessary in either the lower positive stop or the upper positive stop. For example, the first element may alternately be discrete from its endcap and the starboard lower positive stop second element may be located elsewhere.

As the support assembly 200 is lowered, the starboard strut 242 rotates about the starboard lower pivot joint 244 until the starboard lower positive stop first element contact surface 344 abuts the starboard lower positive stop second element contact surface 346. This contact prohibits further rotation and associated lowering of the support assembly 200. Independently, the starboard strut 242 can be rotated about the starboard upper pivot joint 254 (a.k.a. the starboard upper endcap 252 is rotated about the starboard upper pivot joint 254) until the starboard upper positive stop first element contact surface 354 abuts the starboard upper positive stop second element contact surface 356. This contact prohibits further rotation and associated adjustment of the orientation of the upper structure 400.

When the support structure 200 is in the lower position, a combined weight 360 of the starboard strut 242, the starboard upper endcap 252, and the upper structure 400 collectively create an associated moment arm 362L around the starboard lower pivot joint 244. The combined weight 360 together with the moment arm 362L create a moment that leverages the starboard lower positive stop second element contact surface 346 onto the starboard lower positive stop first element contact surface 344. This significantly increases a force of the mechanical seating therebetween. In other words, combined weight 360 together with the moment arm 362L torque the starboard lower positive stop second element 348 onto the starboard lower positive stop first element 342. The result is that the combined weight 360 of the support assembly 200 helps lock the support assembly 200 into the lower position. This, in turn, increases a stability of the support assembly 200 in the lower position.

In this example embodiment, the combined weight 360 also creates an associated moment arm 362U around the starboard upper pivot joint 254. The combined weight 360 together with the moment arm 362U create a moment that leverages the starboard upper positive stop first element contact surface 354 onto the starboard upper positive stop second element contact surface 356. This significantly increases a force of the mechanical seating therebetween. In other words, the combined weight 360 together with the moment arm 362U torque the starboard upper positive stop first element 352 onto the starboard upper positive stop second element 358. Here again, the combined weight 360 helps lock the support assembly 200 into the lower position, which further increases the stability of the support assembly 200 in the lower position.

During certain watersports activities such as wakeboarding, the person being towed by the vessel imparts a tow force 364 on the tow head 406. When the support structure 200 is in the lower position, an associated moment arm 366 is created about the starboard upper pivot joint 254. The tow force 364 together with the moment arm 366 create a moment that leverages the starboard upper positive stop first element contact surface 354 onto the starboard upper positive stop second element contact surface 356. This significantly increases a force of the mechanical seating therebetween. In other words, the tow force 364 together with the moment arm 366 torque the starboard upper positive stop first element 352 onto the starboard upper positive stop second element 358. The result is that the tow force 364 helps lock the starboard upper endcap 252 into the starboard strut 242, which increases the stability of the support assembly 200 in the lower position.

The tow force 364 also urges the starboard strut 242 to pivot about the starboard lower pivot joint 244 away from the lower position, regardless of whether the support assembly 200 is in the lower or upper position. This is also the case in the prior art configurations. However, when the support assembly 200 is in the lower position, a moment created by the tow force 364 and a moment arm 368 is opposed by the moment created by the combined weight 360 of the support assembly 200 and the moment arm 362L. In addition, the support assembly 200 is designed to withstand the same tow force 364 when the support assembly 200 is in the upper position. When the support assembly 200 is in the upper position, the moment arm (not shown) created by the same tow force 364 is much larger because the tow head 406 is further from the starboard lower pivot joint 244. This increased distance increases the moment of the tow force 364 when compared to the moment created when the support structure 200 is in the lower position. Since the support assembly 200 is designed to handle a much greater forces caused by the tow force 364 when the support assembly 200 is in the upper position, and since the moment created by the tow force 364 is also opposed by the moment created by the combined weight 360 when the support assembly 200 is in the lower position, the moment created by the tow force 364 has little destabilizing effect on the connection between the starboard strut 242 and the starboard lower endcap 240 when the support assembly 200 is in the lower position.

In contrast, the moment created by the tow force 364 and the moment arm 366 significantly contributes to the stability of the connection between the starboard strut 242 and the starboard upper endcap 252 in the lower position. Since the moment created by the tow force 364 has little destabilizing effect on the connection between the starboard strut 242 and the starboard lower endcap 240 when the support assembly 200 is in the lower position, but has a highly stabilizing effect on the connection between the starboard strut 242 and the starboard upper endcap 252 when the support assembly 200 is in the lower position, the tow force 364 is considered to increase the overall stability of the support assembly 200 when the support assembly 200 is in the lowered configuration relative to the prior art.

Should the support assembly 200 be used in a position between the lower position and the upper position, the same kinematics apply (to varying degrees), but instead of applying to the positive stops, they apply to the actuators. In other words, in between the lower position and the upper position, the lower actuator 312 would bear the forces that the starboard lower positive stop 340 would bear with a similar result. Likewise, an upper actuator 316 would bear the forces that the starboard upper positive stop 350 would bear with a similar result. Hence, even when the support assembly 200 is between the upper and lower positions, the tow force 364 stabilizes/strengthens the support assembly 200.

In addition, due to the location of the lower actuator 312 relative to the starboard lower positive stop 340, when the lower actuator 312 retracts and causes the starboard lower positive stop 340 to engage, little force is transferred to the starboard lower pivot joint 244 because the starboard lower positive stop 340 bears the brunt of the force. This is due at least in part to the lower actuator 312 being located closer to the starboard lower positive stop 340 than to the starboard lower pivot joint 244 and leverages associated with such a configuration. The same applies to the upper actuator 316 and the starboard upper positive stop 350.

While the above discussion focuses on the starboard components, the same forces and moment arms may apply to the port components of the support assembly 200.

Further, as shown in FIG. 13, the combined weight 360 pulls the starboard strut 242 to the right and creates a rightward force Fr in the starboard lower pivot joint 244 (as seen in FIG. 13). This creates stress in the starboard lower pivot joint 244. Once the starboard lower positive stop 340 engages, if the lower actuator 312 is further actuated to increase the seating force of the starboard lower positive stop 340, the lower actuator 312 may begin to pivot the starboard strut 242 counterclockwise (as seen in FIG. 13) about the starboard lower positive stop 340. This action may relieve or overcome some of the rightward force Fr of the starboard strut 242 in the starboard lower pivot joint 244, and thereby relieve some of the stress in the starboard lower pivot joint 244.

While the above discussion focuses on the starboard lower pivot joint 244, the same forces and moment arms may apply to port lower pivot joint 214.

Figure 14:
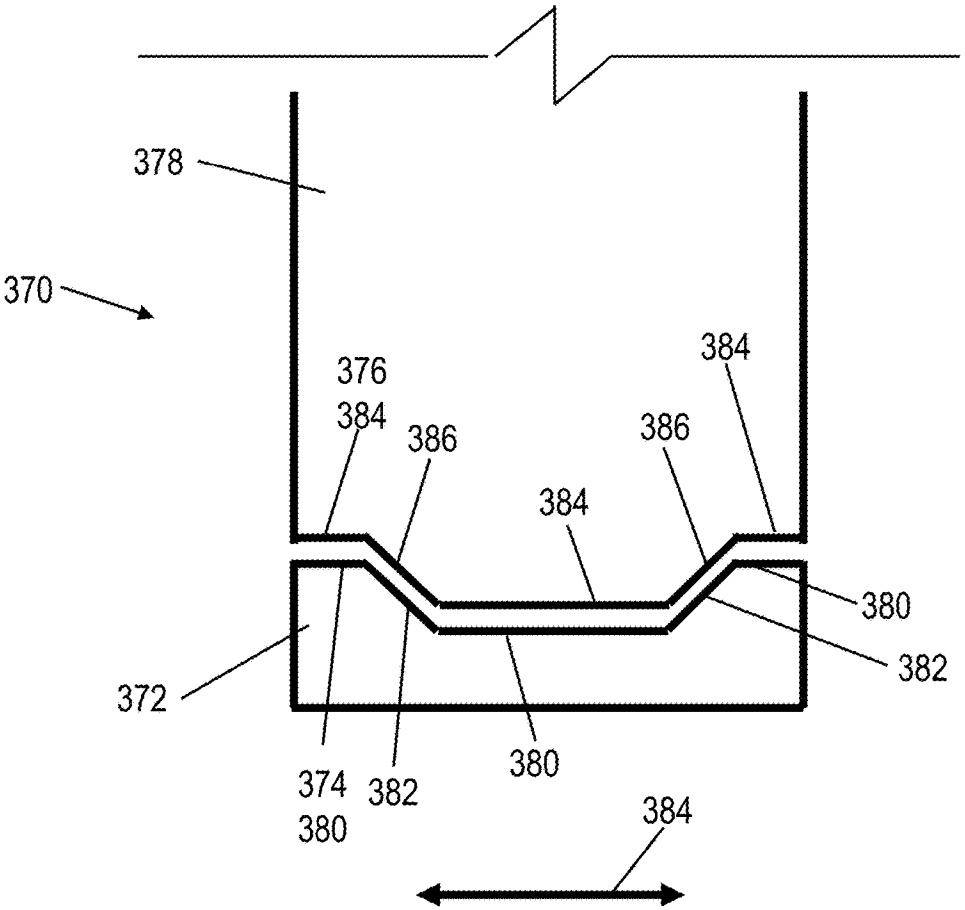
FIG. 14 is a view along A-A of FIG. 13 of an alternate example embodiment of a positive stop.

FIG. 14 shows an alternate example embodiment of a positive stop 370 as viewed along line A-A of FIG. 13. This positive stop 370 can be used anywhere a positive stop is used. The positive stop 370 includes a first element 372 having a first element contact surface 374 that abuts (e.g., mechanically seats with) a second element contact surface 376 of a second element 378 when the support assembly 200 is in the lower position. The elements may be associated with other elements of the support assembly 200 as they are above, or they may be positioned as desired to generate the appropriate positive stop. In this example embodiment, the first element contact surface 374 includes flat sections 380 and tapered sections 382 (as seen in FIG. 14). The second element 378 includes flat sections 384 and tapered sections 386 (as seen in FIG. 14). The flat surfaces 380, 384 stop circumferential motion (e.g., pivoting around the respective pivot joint) when they abut each other. The tapered sections 382, 386 stop circumferential motion (e.g., pivoting around the respective pivot joint) when they abut each other. In addition, the tapered sections 382, 386 restrict movement between the first element 372 and the second element 378 in a lateral direction 390 once engaged/fully engaged with each other.

When the moments described above leverage the first element 372 and the second element 378 together, the tapered sections 382, 386 will initially correct any misalignment between the associated endcap and strut as well as reduce and then eliminate (upon full engagement) lateral relative movement therebetween. Consequently, a tapered positive stop 370 adds further lateral stability to the support assembly 200 in the lower position beyond that provided by the laterally outward point of contact 292 and the laterally inward point of contact 294.

Figure 15:
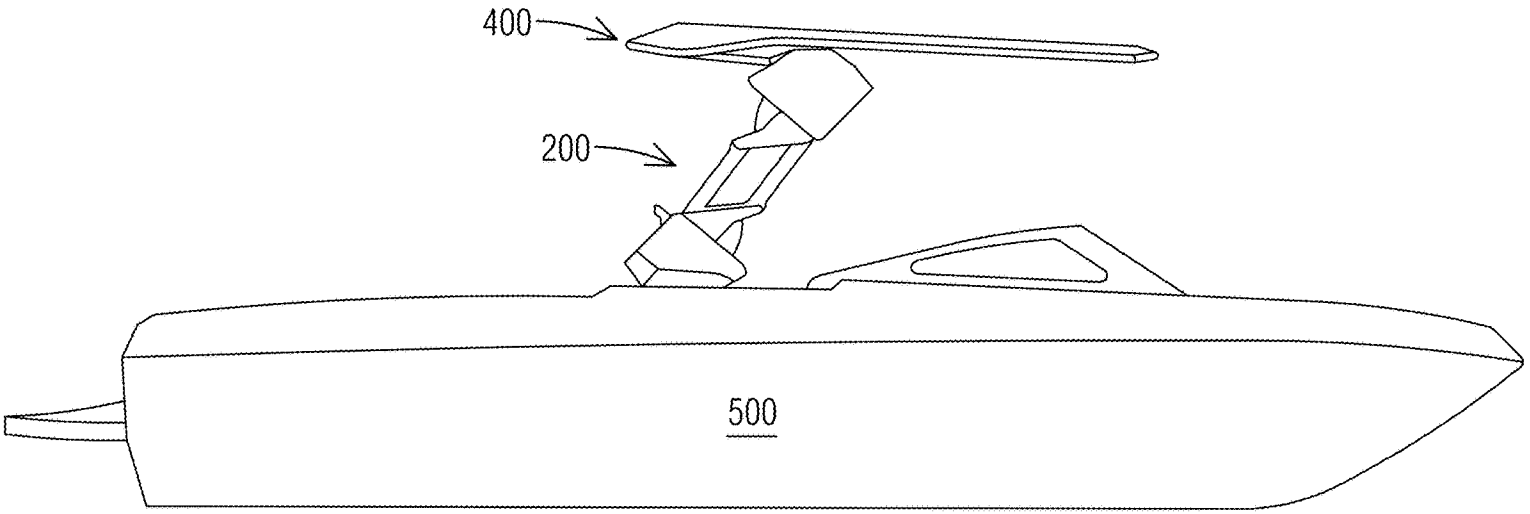
FIG. 15 shows an example embodiment of the support structure and upper structure including the top cover installed on a marine vessel and in the upper position.
Figure 16:
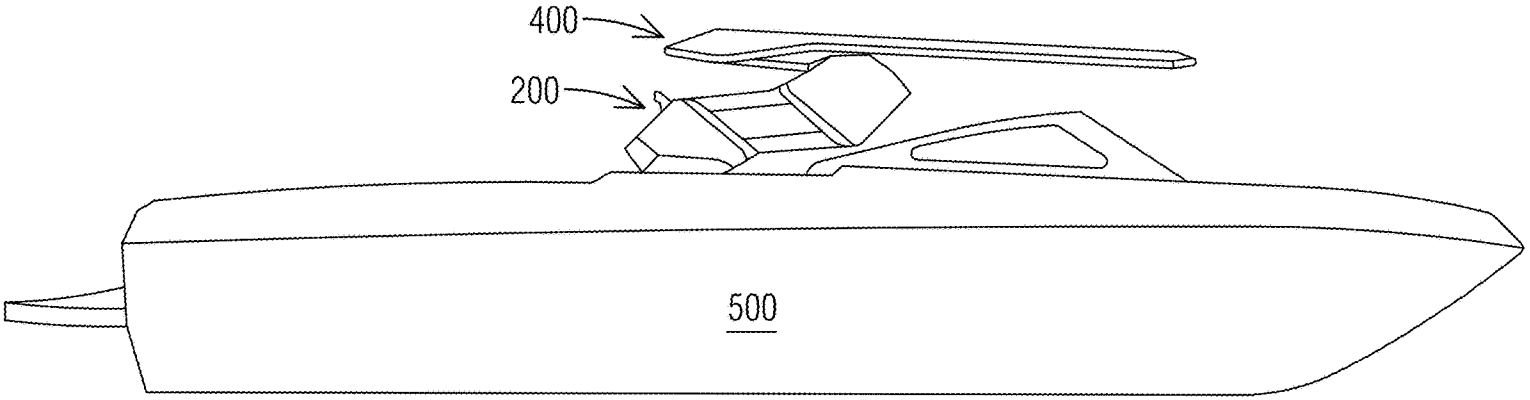
FIG. 16 shows the support structure and upper structure on the marine vessel of FIG. 15 in the lower position.

FIG. 15 shows the support structure 200 and the upper structure 400 in the upper position and installed on a marine vessel 500 via a rigid connected between the lower endcaps and the marine vessel 500. FIG. 16 shows the support structure 200 and the upper structure 400 in the lower position on the marine vessel 500. The upper position provides the greatest headroom and exposure to the elements but requires the greatest vertical clearance. Consequently, the upper position is suitable for standing occupants, when exposure to the elements is desirable, and/or when there are no clearance requirements. The lower position is suitable for seated occupants, when reduced exposure to the elements is desirable (by "tenting in" the occupants) during operation and/or when stationary, and/or low clearance requirements (e.g., low bridges, trailering). In addition, the lower position provides greater access to the upper structure 400. Hence, items such as sports boards that are stored thereon or in pockets thereon may be more easily accessed.

As can be seen from the above, the present inventors have disclosed a support assembly and associated upper structure that is stronger, more versatile, safer, and more useful than the prior art configurations. Hence, the disclosure herein represents and improvement in the art.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An apparatus, comprising a support assembly, the support assembly comprising:

a lower endcap, an upper endcap, a strut, a lower pivot joint between the lower endcap and a lower end of the strut, and an upper pivot joint between the upper endcap and an upper end of the strut;

wherein the support assembly is configured to selectively move an upper structure relative to a motor vehicle between an upper position via rotation at each pivot joint which increases a distance between respective endcap centroids, and a lower position via rotation in an opposite direction at each pivot joint which decreases the distance between the respective endcap centroids.

2. The apparatus of claim 1, wherein the lower endcap is configured to be immovably fixed to the motor vehicle so the rotation of the strut in a first direction about the lower pivot joint raises the upper end of the strut.

3. The apparatus of claim 2, wherein rotation of the strut about the upper pivot joint adjusts an orientation of the upper structure.

4. An apparatus, comprising a support assembly, the support assembly comprising:

an endcap, a strut, and a pivot joint between the endcap and an associated end of the strut;

wherein the pivot joint comprises a discrete guide arrangement comprising sliding contact between the strut and the endcap that is configured to maintain a rotational alignment therebetween as the endcap rotates about the pivot joint;

wherein the support assembly is configured to selectively move an upper structure of a motor vehicle between an upper position and a lower position by rotating the strut;

wherein the guide arrangement comprises an endcap contact surface in the sliding contact with a strut contact surface; and wherein one of the endcap contact surface and the strut contact surface comprises an arcuate shape centered on a pivot axis of the pivot joint.

5. The apparatus of claim 4, further comprising:

a further endcap, a further pivot joint between the further endcap and an associated further end of the strut, and a further guide arrangement comprising sliding contact between the further end of the strut and the further endcap that is configured to maintain a rotational alignment therebetween as the further endcap rotates about the further pivot joint.

6. The apparatus of claim 4, wherein the endcap is configured to be immovably fixed to the motor vehicle so rotation of the strut in a first direction about the pivot joint raises the endcap.

7. The apparatus of claim 4, wherein the endcap is configured to be secured to the upper structure and to adjust an orientation of the upper structure by rotating about the pivot joint.

8. The apparatus of claim 4, wherein the guide arrangement comprises a tongue and groove arrangement comprising the endcap contact surface and the strut contact surface.

9. The apparatus of claim 8, wherein the strut comprises a tongue of the tongue and groove arrangement on which the strut contact surface is disposed, and wherein the endcap comprises a groove of the tongue and groove arrangement on which the endcap contact surface is disposed.

10. The apparatus of claim 8, wherein the tongue comprises a shape of at least a circumferential portion of a disk.

11. The apparatus of claim 4, further comprising the upper structure, wherein the upper structure comprises a top cover.

12. The apparatus of claim 1, the support assembly further comprising:

a lower actuator disposed between the lower endcap and the lower end of the strut; and an upper actuator disposed between the upper endcap and the upper end of the strut;

wherein the lower actuator extends to rotate the strut about the lower pivot joint and thereby raise the upper endcap; and wherein the upper actuator is configured to extend to rotate the upper endcap about the upper pivot joint to maintain an orientation of the upper structure as the lower actuator raises the upper endcap.

13. The apparatus of claim 1, further comprising:

a top cover;

wherein the support assembly further comprises an adjustable top cover connection configured to secure the top cover to the upper endcap and to selectively position the top cover forward and aft relative to the upper endcap; and wherein selectively independently pivoting the strut about the lower pivot joint raises and lowers the top cover relative to the motor vehicle; wherein independently pivoting the top cover about the upper pivot joint adjusts an orientation of the top cover; and wherein selectively independently adjusting the top cover connection moves the top cover forward and aft relative to the motor vehicle.

14. An apparatus, comprising a support assembly, the support assembly comprising:

an endcap, a strut, and a pivot joint between the endcap and an associated end of the strut;

wherein the pivot joint comprises a discrete guide arrangement comprising sliding contact between the strut and the endcap that is configured to maintain a rotational alignment therebetween as the endcap rotates about the pivot joint;

wherein the support assembly is configured to selectively move an upper structure of a motor vehicle between an upper position and a lower position by rotating the strut;

wherein the guide arrangement comprises an endcap contact surface in the sliding contact with a strut contact surface;

wherein the guide arrangement comprises a tongue and groove arrangement comprising the endcap contact surface and the strut contact surface; and wherein the strut comprises a tongue of the tongue and groove arrangement on which the strut contact surface is disposed, and wherein the endcap comprises a groove of the tongue and groove arrangement on which the endcap contact surface is disposed.

15. An apparatus, comprising a support assembly, the support assembly comprising:

an endcap, a strut, and a pivot joint between the endcap and an associated end of the strut;

wherein the pivot joint comprises a discrete guide arrangement comprising sliding contact between the strut and the endcap that is configured to maintain a rotational alignment therebetween as the endcap rotates about the pivot joint;

wherein the support assembly is configured to selectively move an upper structure of a motor vehicle between an upper position and a lower position by rotating the strut;

wherein the guide arrangement comprises an endcap contact surface in the sliding contact with a strut contact surface;

wherein the guide arrangement comprises a tongue and groove arrangement comprising the endcap contact surface and the strut contact surface; and wherein the tongue comprises a shape of at least a circumferential portion of a disk.

* * * * *